US007895947B1

(12) United States Patent
Sutherland et al.

(10) Patent No.: US 7,895,947 B1
(45) Date of Patent: Mar. 1, 2011

(54) WEAPON FUSE METHOD

(75) Inventors: Gerrit Sutherland, White Plains, MD (US); Charles Stevens Coffey, Clarksville, MD (US); Frederica A. Coffey, legal representative, Clarksville, MD (US); Harold Sandusky, Fulton, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 695 days.

(21) Appl. No.: 11/879,525

(22) Filed: Jul. 3, 2007

(51) Int. Cl.
*F42C 15/34* (2006.01)

(52) U.S. Cl. ..... 102/254

(58) Field of Classification Search ..... 102/237, 102/244, 254, 255, 256
See application file for complete search history.

(56) References Cited

U.S. PATENT DOCUMENTS

| | | | | | |
|---|---|---|---|---|---|
| 2,826,992 | A | * | 3/1958 | Czajkowski | 102/244 |
| 2,850,980 | A | * | 9/1958 | Stevenson et al. | 102/241 |
| 2,978,982 | A | * | 4/1961 | Bianchi | 102/244 |
| 3,380,385 | A | * | 4/1968 | Hazelet et al. | 102/254 |
| 3,421,443 | A | * | 1/1969 | Furlani | 102/245 |
| 3,483,822 | A | * | 12/1969 | De Leonardis | 102/245 |
| 3,744,421 | A | * | 7/1973 | Seeger | 102/254 |
| 4,004,521 | A | * | 1/1977 | Andrejkovics | 102/267 |
| 4,237,788 | A | * | 12/1980 | Hagen | 102/245 |
| 4,240,351 | A | * | 12/1980 | San Miguel | 102/262 |
| 4,480,551 | A | * | 11/1984 | LoFiego | 102/245 |
| 4,691,635 | A | * | 9/1987 | Winterhalter et al. | 102/251 |
| 4,928,595 | A | | 5/1990 | Weingart | |
| 5,080,016 | A | | 1/1992 | Osher | |
| H1078 | H | | 7/1992 | Norris et al. | |
| 5,275,106 | A | | 1/1994 | Cutting et al. | |
| H1304 | H | | 4/1994 | Norris et al. | |
| 2006/0260499 | A1 | * | 11/2006 | Westphal et al. | 102/254 |

OTHER PUBLICATIONS

U.S. Appl. No. 11/820,041, filed Jun. 8, 2007, Sutherland et al.

* cited by examiner

*Primary Examiner*—Bret Hayes
(74) *Attorney, Agent, or Firm*—Fredric J. Zimmerman

(57) ABSTRACT

A warhead fuse mechanism is used to prevent an accidental explosive event of a warhead by positioning a booster lead carrier, having a booster lead segment, positioned between the warhead detonator and warhead explosive. In a safe position the booster lead segment is off-set from alignment with the warhead detonator and warhead explosive. The warhead fuse is armed by rotating either the warhead detonator or booster lead carrier to align the warhead detonator and booster lead segment to form a detonation chain between the warhead detonator and warhead explosive.

8 Claims, 4 Drawing Sheets

Armed Mode
20/22A/22B/22C
38
22A/22B/22C}22A-22x/22
50
52
38A/38B/38C}38A-38x
10
20
38

Safe Mode
22A
22B
22C
20
38
100
10
20
22A
22B
22C
38
38A
38B
38C
50
52

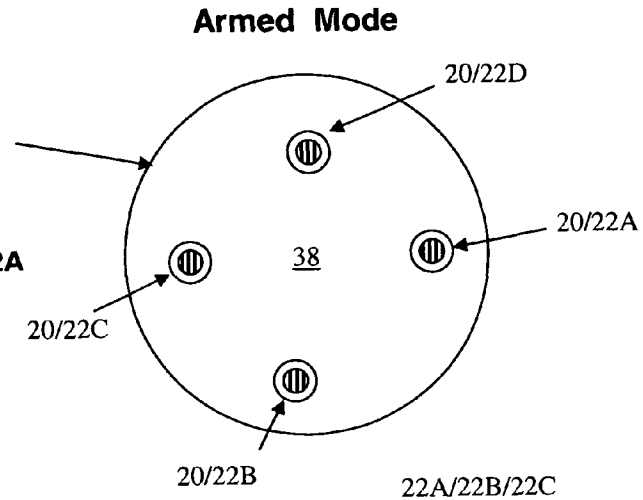
FIG. 2A
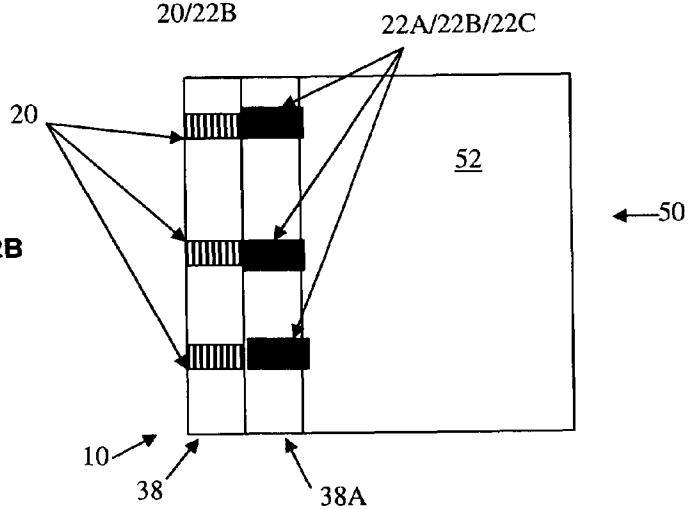
FIG. 2B
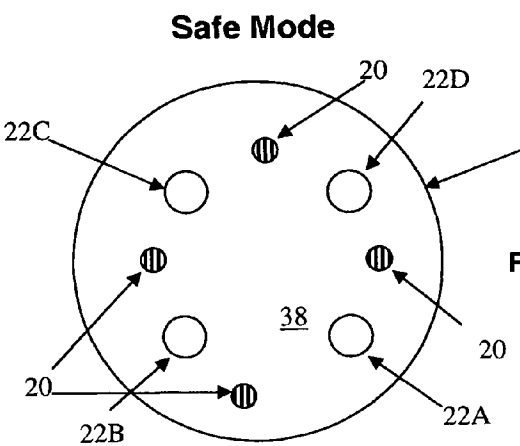
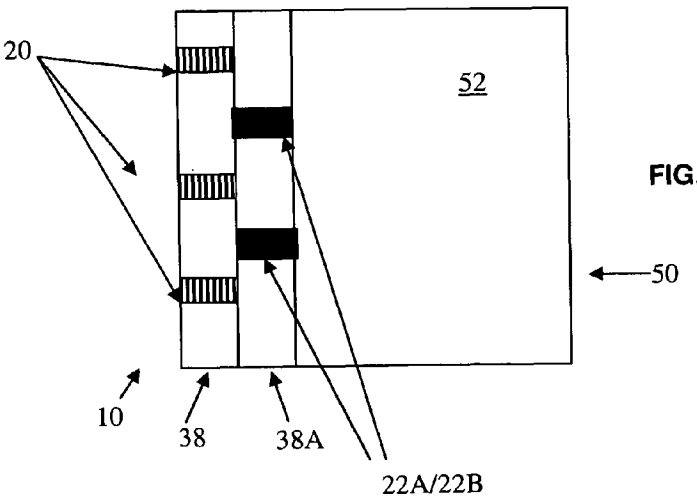

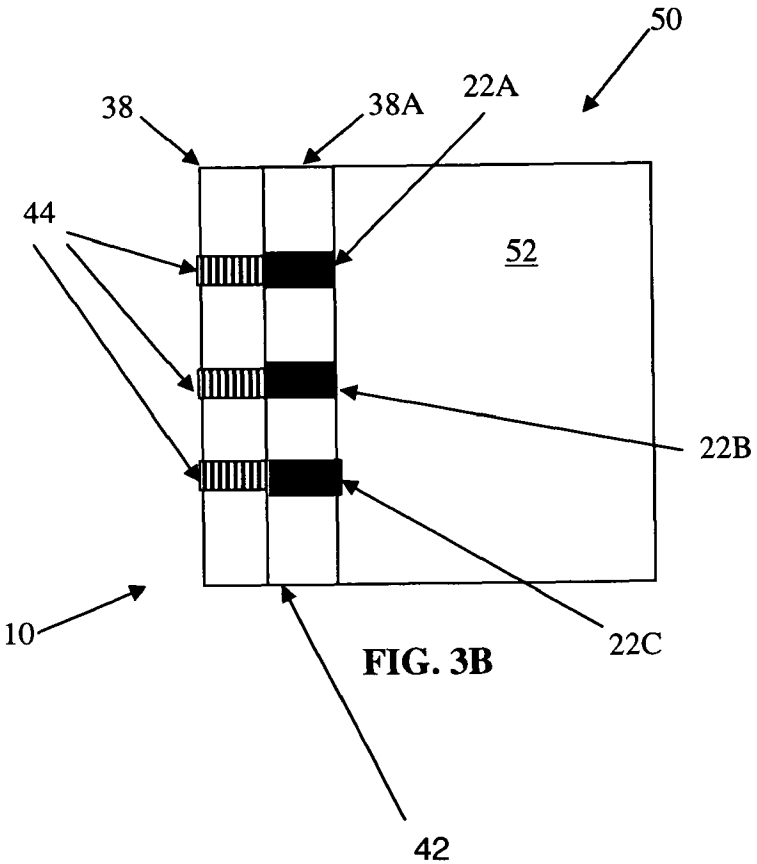
FIG. 3B
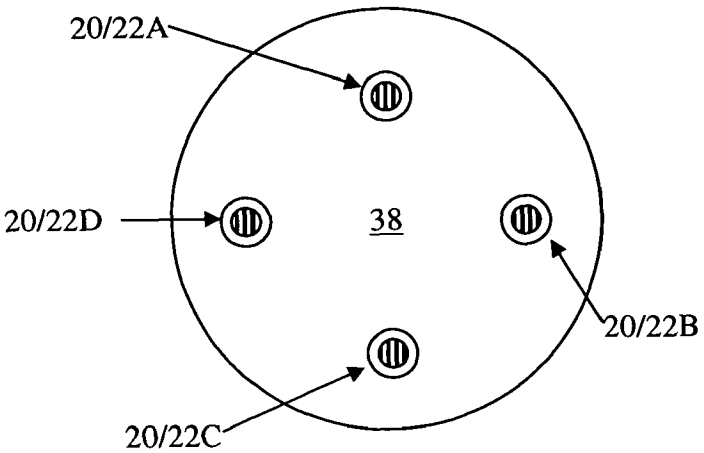
FIG. 3A
FIG. 3

WEAPON FUSE METHOD

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention provides a safety mechanism useful in warhead fuses that sufficiently restricts the alignment of the booster lead and the warhead detonator to preclude transfer of an explosive event through the booster lead thereby preventing accidental detonation of the warhead main charge.

2. Related Art

Typically, conventional explosive trains include a fuze, detonator, safe/arm mechanism, booster charge, and explosive device or warhead. Current fuses such as those incorporated in general purpose bombs used by the military contain a pellet of booster explosive to initiate the main charge explosive. The fuse pellet may be made from a primary explosive to allow a slapper or detonator to initiate the booster pellet. However, the primary explosive may be subject to an accidental detonation, such as high-speed fragment impact, cook off, or other initiating occurrence resulting from shipboard accidents or operations, mishandling, etc. With accidental detonation, the primary explosive is likely to detonate the main charge explosive. One example of a munition that suffers from the problem of accidental armed deployment is the M230/M231 fuze used on the sub-munitions of the 2.75 multi-purpose sub-munition (MPSM) Rocket Warhead. This munition contains a spring loaded (stored energy) firing pin, which can cause unintentional or accidental detonation of armed dud sub-munitions, such as the M73/M75, on the battlefield or upon accidental expulsion. Accidental explosion of sub-munitions on board warships or other installations present potentially serious safety hazards to personnel, equipment and expensive weapon systems.

Safe/arm mechanisms are interposed between the detonator and booster to protect the explosive device from accidental detonation. The safe/arm mechanisms may include out-of-line methodologies whereby the detonator is separated from the booster by one or more physical barriers. Accidental detonation of the detonator can not penetrate the physical barrier and detonate the warhead. Although this method is simple and direct, it may not always prove reliable.

The military has fielded main charge explosives such as PBXN-113 and AFX-757 that are qualified as Extremely Insensitive Detonating Substances (EIDS) or 1.6S materials. EIDS materials offer less susceptibility to stimuli such as fragment attack and cook off. A warhead having a detonator, fuse, and main charge explosive meeting the 1.6 standard need fuses that are less vulnerable to fragment attack and thermal cook off.

There is a need in the art to provide improved safety of fuse mechanisms for explosives. The present invention addresses this and other needs.

SUMMARY OF THE INVENTION

The present invention includes a weapons system having a warhead fuse for preventing an accidental explosive event of a warhead including the warhead explosive, a warhead fuse having a detonator effective for detonating the warhead explosive, at least one booster lead carrier positioned between the warhead detonator and warhead explosive and at least one booster lead segment within the booster lead carrier, wherein either the warhead detonator or booster lead carrier is rotatable effective to align the warhead detonator and booster lead segment to form a detonation chain between the warhead detonator and warhead explosive. In an exemplary embodiment, multiple booster lead segments reside within the booster lead carrier that may be rotated to place each booster lead segment adjacent to the warhead explosive. In this configuration, several or all of the multiple booster lead segments must fire in a substantially simultaneous manner for warhead explosive detonation, i.e., no individual booster lead segment supplies sufficient energy transfer to the warhead explosive for detonation of the warhead explosive.

The present invention also includes a method for preventing an accidental explosive event of a warhead including the steps of providing a weapons system having a warhead explosive, warhead fuse having a warhead detonator effective for detonating the warhead explosive, at least one booster lead carrier positioned between the warhead detonator and warhead explosive and at least one booster lead segment within the booster lead carrier, where either the warhead detonator or booster lead carrier is rotatable effective to align the warhead detonator and booster lead segment to form a detonation chain between the warhead detonator and warhead explosive, and rotating either the at least one booster lead segment or warhead detonator out of alignment from each other. A detonation of either at least one booster lead segment or detonator provides insufficient energy transfer for warhead explosive detonation. A warhead explosive may be detonated once the booster lead segment and warhead detonator are aligned with each other.

BRIEF DESCRIPTION OF THE DRAWINGS

FIGS. 2A and 2*b* illustrate, respectively, end and side views of safe and armed modes of the present invention showing a rotating fuse design with multiple rotating booster lead carriers/chambers joining at multiple point initiation conduits;

FIGS. 3A and 3B illustrate, respectively, end and side views of an armed mode of the present invention showing a rotating fuse design with multiple rotating booster lead carriers/chambers joining at multiple point initiation conduits where initiation requires multiple hits by mini flyer plates propelled by a slapper device; and, FIG. 4 shows the steps for arming a fuse of the present invention.

DETAILED DESCRIPTION OF THE INVENTION

The present invention provides a safe and arming fuse system for weapon systems containing insensitive main charge explosives. The present invention restricts booster lead length and/or energy potential to prevent it from supplying enough energy to detonate the main charge explosive. In one embodiment, the weapon system may be armed to allow detonation of the main charge by combining the unitized booster leads together in a manner that increases the thickness of the combined booster leads to acquire sufficient energy for detonation of the main explosive. The fuse mechanisms of the present invention divide booster leads into separate units along the length of the booster lead that are individually ineffective for conducting an explosive event through the booster lead with sufficient potential to initiate the main or preliminary explosive (collectively referred to herein as the main explosive unless otherwise designated). Some or all of the booster lead segments possess a diameter greater than the failure diameter of the particular explosive composition of the booster lead segment, but do not individually possess adequate thickness for detonation of the main explosive. Additionally, segregation of the booster lead units from one another isolates these units so that the booster lead units are unable to transfer any explosive event into the main charge of the warhead. In another embodiment, the present invention requires simultaneous activation of multiple booster leads to supply enough energy to detonate the main charge explosive. While the booster lead units remain individually separated, physically and/or operationally, when the fuse is subjected to conditions that would normally promote an explosive reaction through the booster lead, such as an accidental dropping, exposure to fire, etc., the explosive event is incapable of imparting the energy necessary for detonation into the main explosive. This configuration provides a fuse design of the present invention that makes the warhead less vulnerable to thermal cookoff, mishandling, fragment attack or other such stimuli. As such, accidental detonations of the main charge do not occur while the booster lead is placed in a safe condition, i.e., the booster lead units are isolated. Once the booster lead units are combined, the explosive event can transfer through the booster lead, ending in an operational explosive event of the main charge. The present invention eliminates the need for a booster pellet made of secondary explosive. When combined with a new 1.6 explosive, the present invention provides a safe arming mechanism of warheads that is less vulnerable to fragment attack and cook off. Additionally the fuse of the present invention decreases warhead vulnerability for warheads not using 1.6 explosives.

Figures 1A, 1B:
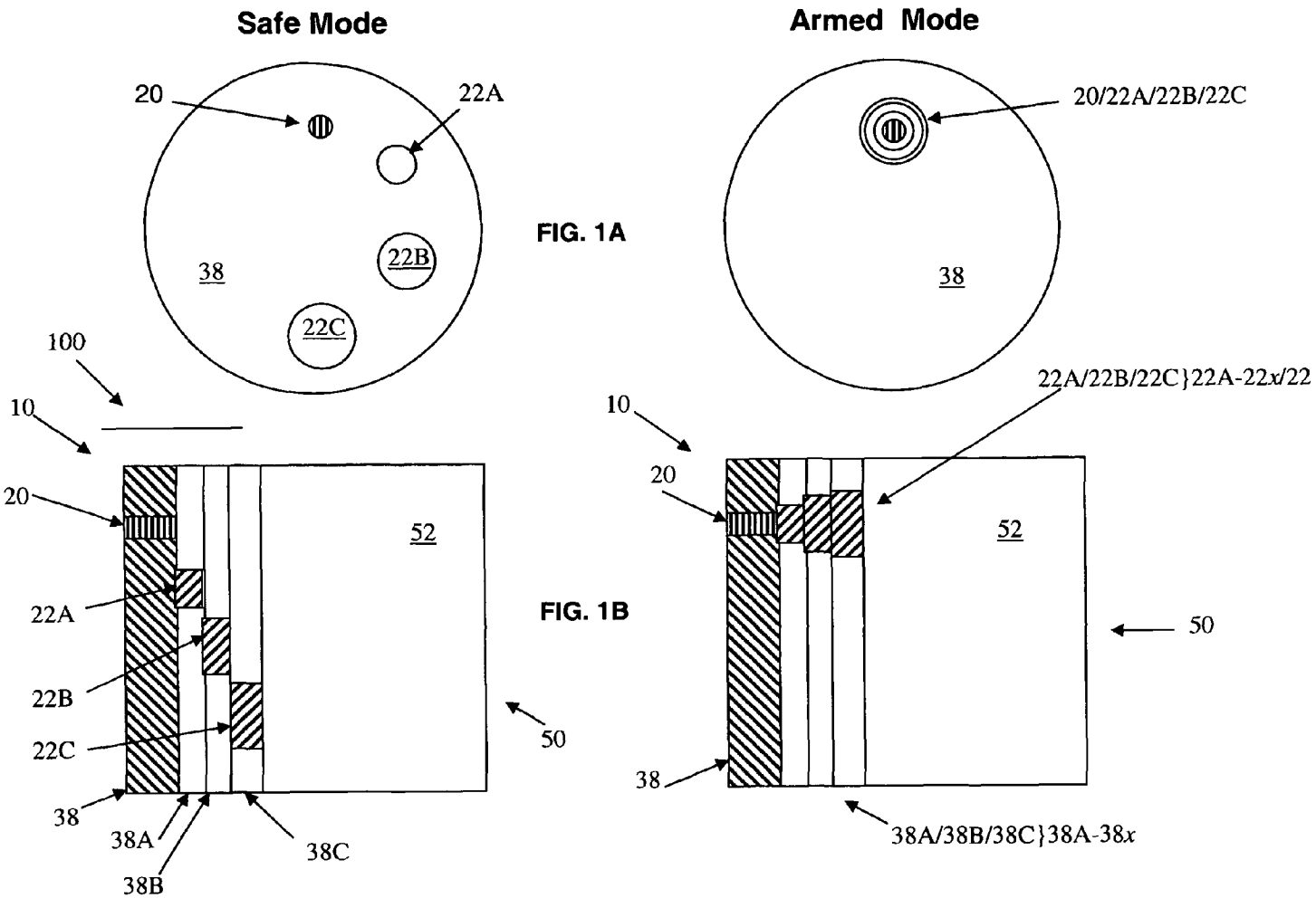
FIGS. 1A and 1B illustrate, respectively, end and side views of safe and armed modes of the present invention showing a rotating fuse design with multiple rotating booster lead carriers/chambers joining at a single conduit.

Referring to FIGS. 1A and 1B, end and side views of a weapon system 100 having a warhead fuse 10 of the present invention are shown, showing both a safe mode and armed mode of the present invention. A warhead explosive 50, along the train of the warhead fuse 10, generally includes an insensitive main explosive charge 52, such as PBXN-113, AFX-757 or other 1.6S materials. As further shown in FIGS. 1A and 1B, the warhead fuse 10 includes a warhead detonator 20 that is sufficiently powerful to initiate detonation of an adjacent booster lead unit or segment 22A. The detonator 20 resides in an independent disk 38 separate from a booster lead carrier 38A that supports the booster lead segment 22A, with the independent disk 38 and booster lead carrier 38A laterally rotatable relative to each other. As seen in the safe mode representation of FIGS. 1A and 1B and in FIGS. 2A and 2B, the warhead fuse 10 maintains a safe condition while the booster lead segment 22A has been laterally separated from the proximity of the detonator 20. The detonation of any booster segment will not have enough energy to detonate main charge explosive 52 from its fixed position in the safe mode. Referring to FIGS. 1A and 1B, additional booster lead segments 22B and 22C (with additional booster lead segments 22D-22*x*, where x represents a finite number of booster lead segments; collectively referred to as 22A-22*x*, see FIG. 1B), located in additional booster lead carriers 38B-38C (collectively 38B-38*x*) are likewise separated or isolated from each other through lateral displacement effective for imparting a safe mode onto the fuse 10. In the configuration of FIG. 1B, booster lead segment 22A also has been laterally separated as well as off-set from the proximity of the booster lead segment 22B, with the plurality of the individual booster lead segments 22A-22*x* constituting the booster lead 22 of the fuse 10. Accordingly, the booster lead segment(s) 22A is offset from alignment with the detonator 20 and the warhead explosive 50. Further, the individual booster lead segments 22A-22*x* each retain an effective critical diameter greater than the failure diameter of the booster lead composition, however, the booster lead segments 22A-22*x* individually have a restricted thickness that is insufficient to detonate the warhead explosive 50. In the rotating fuse design of FIG. 1B, the multiple rotating booster lead carriers 38B-38*x* allows optimization of the booster lead segments 22A-22*x*, such as for example, using different booster explosives for some or all of the booster lead segments 22A-22*x*, which allows changes in size, configuration and operational effect of the fuse 10. For example, in FIG. 1, booster lead segment 22C possesses a diameter above the failure diameter of its explosive.

For a cylindrical explosive charge, the charge must be over a given diameter called the failure diameter for a detonation to propagate. This feature also applies to other geometries; for square stock there is a certain width (thickness) needed, etc. Failure diameter includes specified diameters of an explosive component necessary for conducting an explosive event through the length of the explosive, i.e., failure diameter is the minimum diameter of material needed to propagate a detonation wave. Failure diameter calculations are well known in the explosives art, with failure diameter ($D_f$) of a line or length of an explosive being the minimum diameter in which a steady self-sustaining detonation wave can be propagated. For diameters smaller than $D_f$, any attempt to generate such a steady wave will fail, i.e., it will result in a shockwave that quickly decays to zero strength. For example, United States Statutory Invention Registration nos. H1078 and H1304, both to Norris et al., describe the failure diameter of CL-14 for small booster and large main charge applications.

The restricted thickness of the booster lead segments 22A-22*x* provides effective energy for detonation to continue in adjacent booster lead segments, but does not possess the energy required to initiate warhead explosive detonation. As seen in the armed mode configuration of the FIGS. 1A and 1B, once the booster lead segments 22A-22*x* are aligned, detonation of the detonator 20 initiates detonation of booster lead segment 22A, which in turn initiates detonation in booster lead segment 22B, etc. The combined release energy of the detonation of all of the booster lead segments 22A-22*x* detonates the main explosive charge 52.

The number of divisions of the booster lead 22 into booster lead segments 22A-22*x* may include any appropriate number that allows for segregating the individual booster lead segments 22A-22*x* from each other and for controlling the individual booster lead segments 22A-22*x* within the booster lead carriers 38A-38*x* for operational control of alignment and disarrangement of the booster lead segments 22A-22*x* for safe and armed modes of the present invention. Representative numbers of individual booster lead segments 22A-22*x* include, for example, from about 2 or more booster leads, with from about 3 to 5 booster leads more particularly, and, in another exemplary embodiment, about 3 booster leads. In an exemplary embodiment, the booster lead segments 22A-22*x* are configured to laterally abut each other along a broad surface area when they are merged together. Generally, as each individual booster lead segment 22A-22*x* abuts another individual booster lead segment, the booster lead segments 22A-22*x* are joined along a planar surface where the abutting of the booster leads 22 maximizes the adjoining surface area and thickness of the combined units. The individual booster lead segments 22A-22*x* may include any appropriate configuration, such as shape configurations that include cross-sectional cylindrical shape, square, rectangular and/or combinations thereof. In an exemplary embodiment, the booster lead segments 22A-22*x*, individually form cylindrical cross-sectional areas.

The booster lead carriers 38A-38*x* are used to separate and effectively isolate the individual booster lead segments 22A-22*x* from the detonator 20, adjacent booster lead segments 22A-22*x* (i.e., other booster lead segments) and/or the main explosive charge 52. The booster lead carriers 38A-38*x* disperse each of the individual booster lead segments 22A-22*x* to isolate, effectively, the booster lead segments 22A-22*x* from one another to maintain the restricted thickness. Effective separation and isolation of the booster lead segments 22A-22*x* includes having the booster lead segments 22A-22*x* parted in a manner where an explosive event within one of the booster lead segments does not transfer into another booster lead segment to detonate the warhead explosive 50. The booster lead carriers 38A-38*x* may include any appropriate separating mechanism for displacement of the booster lead segments 22A-22*x* to restrict the thickness of the booster lead 22, and, in particular, including a rotatable disk system. The booster lead carriers 38A-38*x* may be composed of any appropriate material for incorporation within the fuse 10 of the present invention, such as materials of plastic, metal, ceramic, and composites thereof, with selection of the proper separating mechanism and material determinable by those skilled in the art of warhead fuses.

As seen in FIGS. 1A and 1B, the booster lead carriers 38A-38*x* align multiple booster leads 22A-22*x* of a cap sensitive explosive together to form a combined length. With the booster lead segments 22A-22*x* divided, accidental detonation within the individual booster lead units 22A-22*x* fails to detonate the warhead explosive 50, i.e., main explosive 52 because the divided booster lead segments 22A-22*x* prevent the accidental explosive event from transferring an effective amount of energy through the booster lead 22 and into the warhead explosive 50. Once the booster lead segments 22A-22*x* are combined, as shown in the armed mode of FIGS. 1A and 1B, the thickness of the resulting lead becomes greater than both the required critical thickness of the of booster lead explosive to impart a detonating impact onto a, for example, 1.6 main charge explosive. The required diameter for a 1.6S explosive can be small; tests have shown that a detonation wave will propagate in 0.375@thick square stock of PBXN-113 explosive. As such, a preliminary explosive 54 of PBXN-113 may be used initiate the main charge 52 having another 1.6 explosive.

FIGS. 2A and 2B illustrates, respectively, end and side views of a safe and armed mode of the present invention showing a rotating fuse design with multiple rotating booster lead carriers/chambers joining at multiple point initiation conduits. In this exemplary embodiment of the present invention, multiple point initiation is needed to detonate the main charge 52 of the warhead explosive 50, e.g., the main charge 52 only detonates when most of the detonators 20 fire within a give period of time to impart, effectively, sufficient energy into the main charge 52. Although the number of detonators 20 may be varied to meet design requirements, no single detonator 20 detonation of a corresponding booster lead segment can individually impart enough energy into the main charge 52 for detonation. Referring to FIGS. 2A and 2B, the safe mode representation shows multiple detonators 20 are fixed in a disk 38 adjacent to booster lead carrier 38A retaining booster lead segments 22A-22*x*, and, in particular, with all detonators 20 remaining out of alignment with the booster lead segments 22A-22*x* while the fuse 10 is in the safe mode. Either or both of the disk 38 and booster lead carrier 38A may rotate relative to each other in a manner to bring the laterally displaced detonators 20 and booster lead segments 22A-22*x* adjacent and aligned with each other. With the rotation of the disk and carrier 38A, the fuse 10 becomes armed, as seen in FIGS. 2A and 2B, once the detonators 20 and booster lead segments 22A-22*x* are aligned. Once armed, the combined energetic force of the detonation of multiple booster lead segments 22A-22*x* using the multiple detonators 20 provide an effective energetic input into the main charge 52 for detonation.

Referring to FIGS. 3A and 3B, end and side views of an armed mode of the present invention are shown of a rotating fuse design with multiple rotating booster lead carriers/chambers joining at multiple point initiation conduits. In this embodiment, initiation requires multiple hits, such as that provided by mini flyer plates, and related barrels for mini-flyer plates 42, propelled by a slapper device, that is, "slappers" 44. Simultaneous detonation of the detonators 20 may be accomplished by those skilled in the art using such methodologies as electronic detonation, slapper detonator, etc. In an exemplary embodiment, the detonator 20 of the present invention initiates detonation of main charge explosive 52 using a slapper detonator. Slapper detonators are described in a Lawrence Livermore National Laboratory document, UCRL-77639 by John R. Stroud, entitled "A New Kind Of Detonator—The Slapper", dated Feb. 27, 1976, which operates by exploding a thin metal foil that accelerates a plastic film or flyer across a gap to impact on a high-density secondary explosive, which in turn initiates a main charge explosive. Variations of detonators utilizing the slapper technology have been disclosed in U.S. Pat. No. 4,928,595, issued May 29, 1990 to Richard C. Weingart, U.S. Pat. No. 5,080,016, issued Jan. 14, 1992 to John E. Osher, and U.S. Pat. No. 5,275,106, issued Jan. 4, 1994 to Cutting et al., the disclosure of which are herein incorporated by reference. Without the alignment of the detonators 20 and multiple booster lead segments 22A-22*x*, detonation of the main charge 52 is precluded even with the accidental detonation of one or more of the detonators 20 and/or individual booster lead segments 22A-22*x* because energy imparted into the main charge 52 remains below that necessary for detonation of the main charge 52. In the armed mode shown in the end view of FIG. 3A, the detonators 20 are aligned with the booster lead segments 22A-22*x*. In the side view of FIG. 3B, the booster lead segments 22A-22*x* make a continuous path between the detonators 20 and main charge 52. As such, with the simultaneous detonation of the multitude of detonators 20, sufficient energy is transferred to the main charge 52 for it to detonate.

Additionally, the fuse 10 of the present invention may further include one or more energy absorbing materials between the booster lead segments 22A-22*x* and warhead explosive 50. The energy absorbing material, also referred to as attenuating material, may include separate energy absorbing materials present for each of the individual booster lead segments 22A-22*x*. The attenuating material may include those materials (solid, gas, liquid) used to absorb, dampen, attenuate, block, reduce, dissipate, eliminate, redirect, reflect, divert, delay, isolate, impede, or otherwise decreases effects of the shock produced by one explosive on any surrounding structure, including another explosive or another component. Representative examples include porous materials, including porous solids or liquids, being any material filled in part with compressible elements or a compressible volume (e.g., vacuum, gas, or other material). As used here, a "compressible volume" can be any volume that is filled with a compressible material or a vacuum. The attenuating characteristic of a porous material is related to its strength, density, and porosity.

To achieve desirable attenuating characteristics, a material should be high density and should have a significant volume of (e.g., about 2%-90%) of highly compressible material (gas, vacuum, solid, liquid) dispersed throughout the attenuating material, and, in particular, dispersed uniformly throughout the material. Porous liquids include aerated liquids, which are liquids in which a gaseous phase coexists with a liquid phase. Porous liquids may also be aphron-based liquids or liquids containing hollow spheres or other shells that are filled with gas or vacuum. Alternatively, the porous material may also be a solid, such as cement mixed with hollow microspheres, such as that available under the tradename LITECRETE® from Schlumberger Technology Corporation or other hollow spheres or shells, epoxy mixed with hollow spheres or shells, a honeycomb material, and any other solid filled with a certain percentage of compressible volume. For porous materials, adequate attenuating characteristics may be exhibited by materials having a porosity of about 5%, 10%, 20%, 30%, etc., and the like, with the proper porosity determinable by one skilled in the art through routine experimentation. In further embodiments, instead of compressible volumes to fill pores of a porous solid, a material that exhibits a phase change (referred to as a "phase change" material) may be used. Examples of phase change materials include bismuth and graphite. The attenuating material protects other explosives from shock waves generated by detonation of an explosive.

Figure 4:
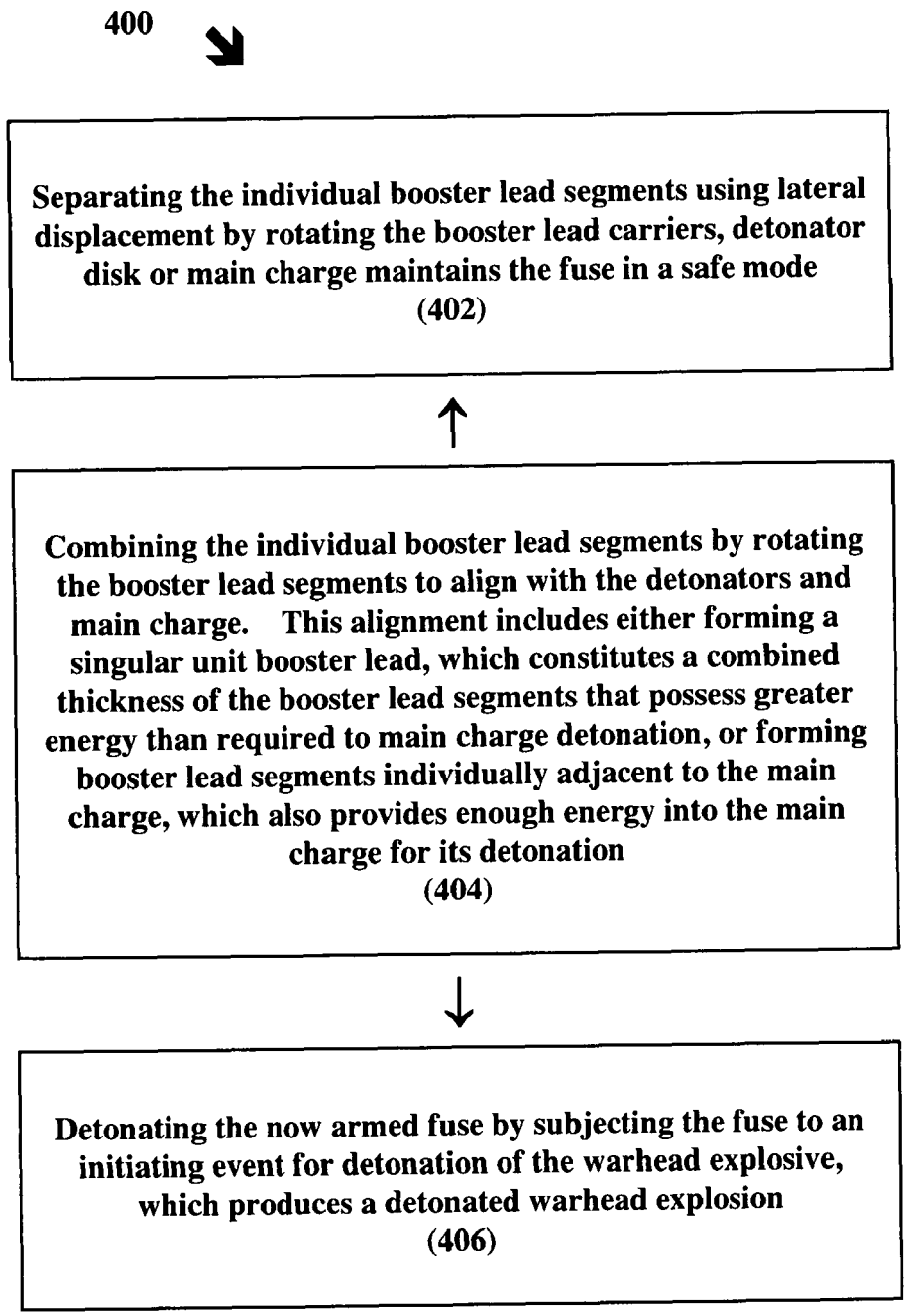

Referring to FIG. 4, steps for arming 400 a fuse 10 of the present invention are shown. Separation 402 of the individual booster lead segments 22A-22*x* using lateral displacement by rotating the booster lead carriers 38A-38*x*, detonator disk 38 or main charge maintains the fuse 10 in a safe mode. The individual booster lead segments 22A-22*x* are combined 404 by rotating the booster lead segments 22A-22*x* to align with the detonators 20 and main charge 52. This alignment includes either forming a singular unit booster lead 22 that constitutes a combined thickness of the booster lead segments 22A-22*x*, which possess greater energy than required to main charge 52 detonation, or forming booster lead segments 22A-22*x* individually adjacent to the main charge 52, which also provides enough energy into the main charge 52 for its detonation. This, now, armed fuse 10 may be subjected to an initiating event for detonation 406 of the warhead explosive 50 which produces a detonated warhead explosion. The individual booster lead segments 22A-22*x* may be aligned at any appropriate timing for the arming of the warhead for operational use, such as, combining the energetic potential of the plurality of booster lead segments 22A-22*x* to allow detonation to occur within time periods, to maximize the safety of the weapon until detonation while allowing effective arming of the weapon. Such times may include, for example, within ten minute, five minutes, one minute, etc. of the detonation of the warhead explosive, such as, 45 seconds, 30 seconds, 15 seconds, etc., and greater, intermediate or lesser times, with optimal times determinable by those skilled in the art in light of the disclosure herein considering such factors as the type of weapon, launch platform, servicing conditions and other such factors that may be applicable to safety and effective detonation of a given weapon. Accidental explosive events to a warhead 50 are prevented using the fuse 10 of the present invention and maintaining the fuse 10 in a safe mode until operational use of the weapon system is desired. By laterally displacing the position of the booster lead segments 22A-22*x* to effect a safe mode, detonation of any of the booster lead segments 22A-22*x* fails to provide an energy transfer to the warhead explosive 50 for warhead explosive detonation.

The use of multiple rotating booster lead carriers allows the weapon system to be placed in, and changed between, a safe mode and armed mode with changes in the radial position of each carrier ring that separates the detonator and each booster lead from each other. Detonation of any one booster lead segment will not supply enough energy to detonate the main charge explosive. In the armed mode, the detonator and booster lead segments are in line, either laterally or horizontally. Booster lead segment thickness is fixed to detonate the main charge only when all booster leads are in line. The booster leads when lined up would be above the critical diameter of both the booster lead explosive and the main charge explosive.

The use of multiple point initiation uses a rotating detonator or booster lead carrier, either or both can rotate. In an exemplary embodiment, when in the armed mode, the detonator and booster are in line. A fire signal results in the simultaneous firing of all detonators and detonation waves will travel down all the leads and hit the main charge explosive simultaneously. For this design, the number and diameter of the booster leads is fixed such that only the simultaneous arrival of detonation waves from most of the booster leads will provide enough energy to detonate the main charge explosive. If a fragment hits the booster lead carrier, then it will not likely simultaneously initiate many of the booster leads and therefore will not likely detonate the main charge explosive. This system eliminates the need for a booster pellet made of secondary explosive. Additionally, when combined with, for example, a 1.6 explosive the warheads are less vulnerable to fragment attack and cook off, and decreasing warhead vulnerability for warheads not using 1.6 explosives.

Example 1 (Prophetic)

A booster lead is formed of 4 equal cylinder shaped sections. The booster lead is composed of CL-14, and each section has a diameter of less than one-third inch and a specified thickness. As the CL-14 has failure diameter of slightly less than one-half inch, the booster lead has an effective diameter for detonation through the combined sections of CL-14. However, the thickness of each section, individually, is unable to detonate the main charge, but combined the booster lead effectively arms and detonates the main charge.

The foregoing summary, description, and examples of the present invention are not intended to be limiting, but are only exemplary of the inventive features which are defined in the claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A method for preventing an accidental explosive event of a warhead, comprising:

providing a weapons system having a warhead explosive, a warhead fuse having a warhead detonator effective for detonating the warhead explosive, at least one booster lead carrier being positioned between the warhead detonator and the warhead explosive, and, at least one booster lead segment within the booster lead carrier, wherein one of the warhead detonator and said at least one booster lead carrier is rotatably effective for alignment of the warhead detonator, and wherein said at least one booster lead segment forms a detonation chain between the warhead detonator and the warhead explosive; and rotating one of said at least one booster lead segment and said warhead detonator out of alignment from each other, wherein a detonation of one of said at least one booster lead segment and said warhead detonator provides insufficient energy transfer for warhead explosive detonation.

2. The method of claim 1, wherein the warhead detonator is rotated out of alignment.

3. The method of claim 1, wherein said at least one booster lead segment is rotated out of alignment.

4. The method of claim 3, wherein a plurality of booster lead segments are rotated out of alignment.

5. The method of claim 3, wherein from about 2 to about 5 booster lead segments are rotated out of alignment.

6. The method of claim 1, further comprising aligning the warhead detonator with said at least one booster lead segment for initiating detonation of the warhead explosive.

7. The method of claim 6, wherein the warhead detonator comprises at least two detonators, and wherein each of said at least two detonators is rotatable for alignment with independent booster lead segments.

8. The method of claim 7, wherein the warhead detonator comprises at least two detonators, and wherein said at least two detonators are simultaneously fired for detonating the warhead explosive.

* * * * *